United States Patent [19]

Schirtzinger

[11] 4,350,114

[45] Sep. 21, 1982

[54] SEMI-SUBMERSIBLE TANKER WITH DIRECTIONAL ICE CUTTERS

[75] Inventor: Joseph F. Schirtzinger, Pasadena, Calif.

[73] Assignee: Sea-Log Corporation, Pasadena, Calif.

[21] Appl. No.: 131,185

[22] Filed: Mar. 17, 1980

[51] Int. Cl.[3] ..... B63G 8/04

[52] U.S. Cl. ..... 114/339; 114/42; 405/61; 405/211

[58] Field of Search ..... 114/40–42, 114/312, 313, 339; 405/61, 211

[56] References Cited

U.S. PATENT DOCUMENTS

| | | | |
|---|---|---|---|
| 926,065 | 6/1909 | Lake | 114/339 X |
| 1,308,738 | 7/1919 | Lake | 114/339 X |
| 3,648,635 | 3/1972 | Hashemi | 114/40 X |
| 3,669,052 | 6/1972 | Schirtzinger | 114/42 X |
| 3,670,681 | 6/1972 | Upchurch, Jr. | 114/40 |
| 3,817,199 | 6/1974 | Schirtzinger | 114/42 |
| 3,868,920 | 3/1975 | Schirtzinger | 114/42 X |
| 3,894,504 | 7/1975 | Smith | 114/42 |
| 4,077,225 | 3/1978 | Lichtenberger et al. | 405/61 X |
| 4,102,144 | 7/1978 | Anders | 114/40 X |

*Primary Examiner*—Richard L. Chiesa

*Attorney, Agent, or Firm*—Christie, Parker & Hale

[57] ABSTRACT

A tanker having a submersible hull has a mast extending above the hull supporting a bridge section. The base of the mast is journaled in the hull for rotation about a vertical axis. The bridge section is rotatably supported on the mast. Drive means rotates the mast relative to the hull and the bridge section such that the hull and bridge section remain aligned while the angular position of the mast is changed. Rotary ice cutters are positioned along one side of the mast and are positioned relative to the surrounding ice by rotation of the mast so as to be aligned with the direction in which the ice encroaches on the mast.

5 Claims, 5 Drawing Figures

SEMI-SUBMERSIBLE TANKER WITH DIRECTIONAL ICE CUTTERS

FIELD OF THE INVENTION

This invention relates to submersible vessels operable in ice covered waters.

BACKGROUND OF THE INVENTION

In U.S. Pat. No. 3,868,920 there is described a cargo vessel having a submergible cargo carrying hull and a bridge from which the vessel is operated supported above the surface by a mast projecting from the hull. The vessel therein described is designed to operate in ice covered waters by submerging the hull below the surface of the ice with the bridge supported above the surface of the ice by the mast. Rotary ice cutters extending along the front edge of the mast operate to cut a path in front of the mast. The vessel therein described serves to transport petroleum and other mineral values from arctic shores to the consuming areas of the United States and other parts of the world in a safe, economical and year-round transportation system.

SUMMARY OF THE INVENTION

The present invention is an improvement on the vessel described in the above-identified patent. One problem encountered in navigation of the semi-submersible tanker is that surface winds or water currents may produce relative movement between the surface ice and the vessel which is at an angle relative to the heading of the vessel. As a result, the surface ice may encroach on the position of the mast from any direction. Since the ice cutting arrangement is designed to cut a path ahead of the mast in the direction in which the vessel is pointing, lateral encroachment of the ice may force the vessel off its course or require delicate maneuvering of the vessel to clear the ice in a direction in which the vessel is intended to move.

The present invention provides a mast with its ice cutters along one edge that is rotatable relative to the hull while still providing support for the bridge. This is accomplished, in brief, by providing a semi-submersible tanker comprising a submergible hull including propulsion means, depth control means and attitude control means for directing the hull beneath the surface of the water and beneath any ice floating on the surface of the water. A bridge section including means for monitoring and controlling the speed, depth, and attitude of the hull is supported above the ice and the surface of the water by a mast projecting from the hull. The mast includes a base which is circular in cross-section and journaled in the hull for rotation about a generally vertical axis. The mast is formed with a leading edge that extends at an angle to the axis of rotation. Rotary ice cutters are positioned along the leading edge of the mast. By rotating the mast relative to the hull, the ice cutters can always be positioned between the encroaching ice and the mast. At least a portion of the bridge is supported on the mast for rotation about a vertical axis parallel to the axis of rotation of the mast. The rotation of the bridge section is controlled such that the bridge section is always aligned with the hull regardless of changes in the angular position of the mast.

BRIEF DESCRIPTION OF THE DRAWINGS

For a more complete understanding of the invention reference should be made to the accompanying drawings, wherein.

DETAILED DESCRIPTION

Figure 1:
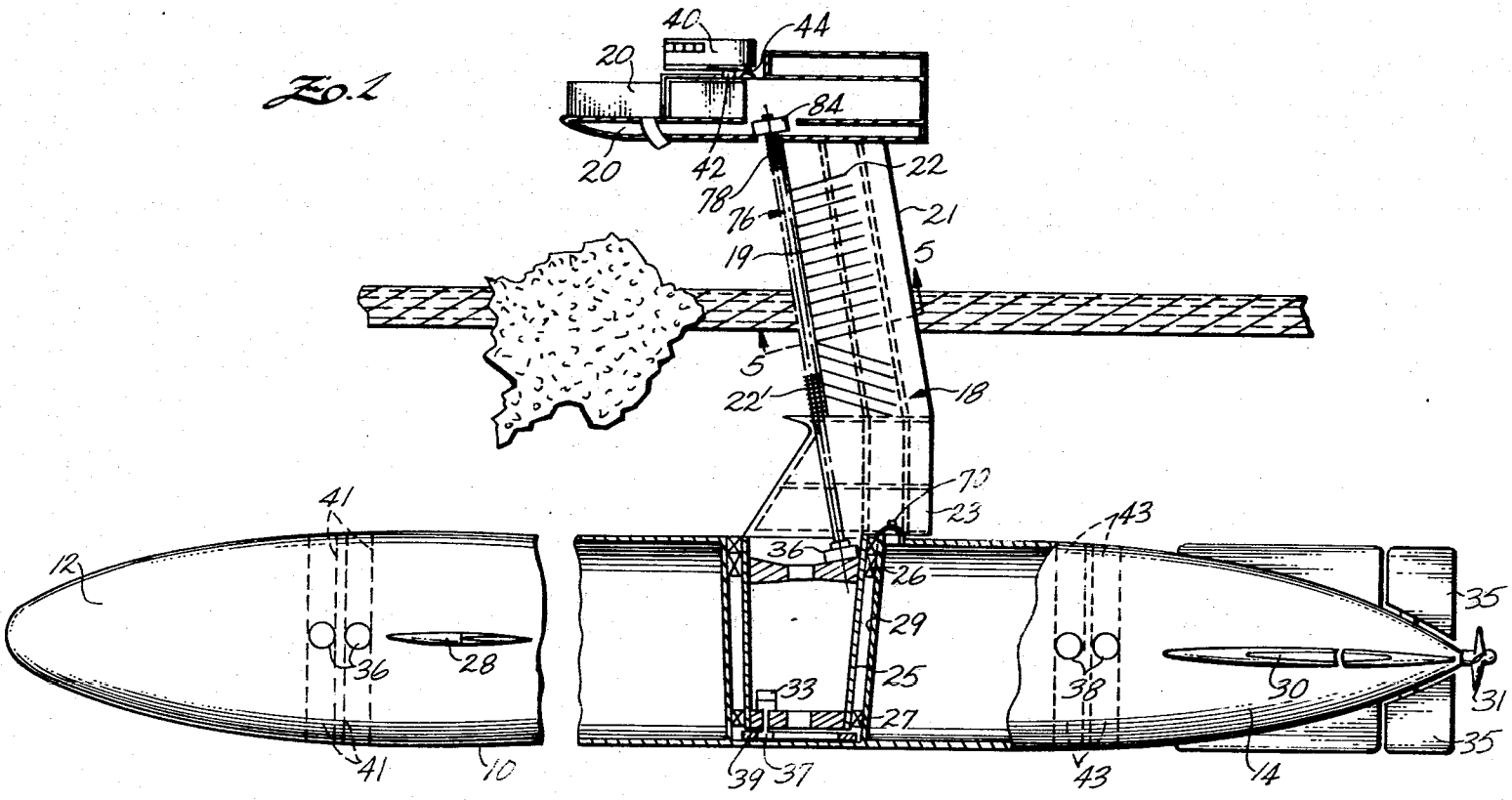
FIG. 1 is a partial elevational view showing the bow and stern sections of the vessel of the present invention.
Figure 2:
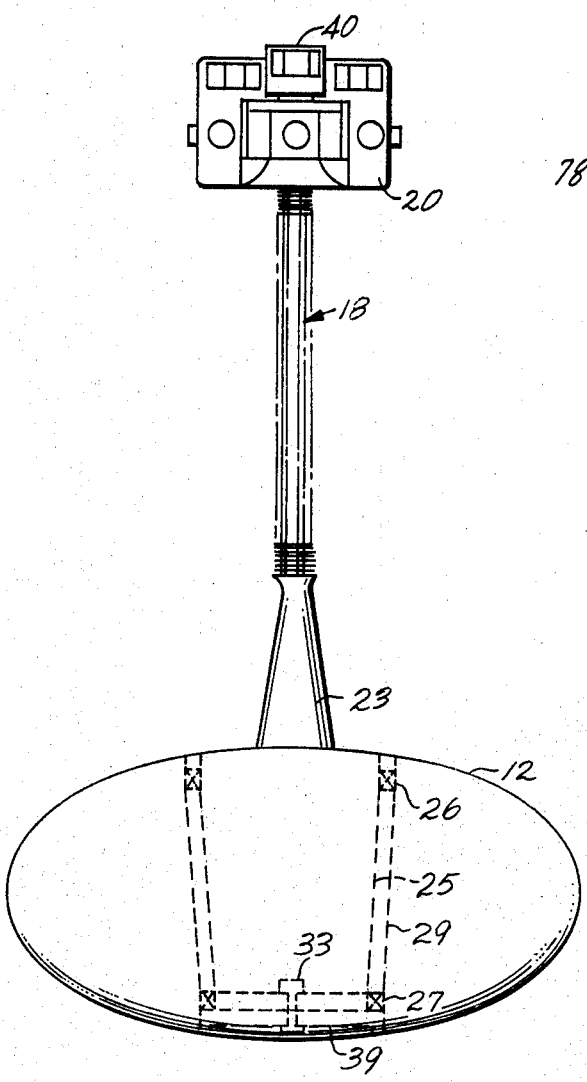
FIG. 2 is a front elevational view.
Figure 4:
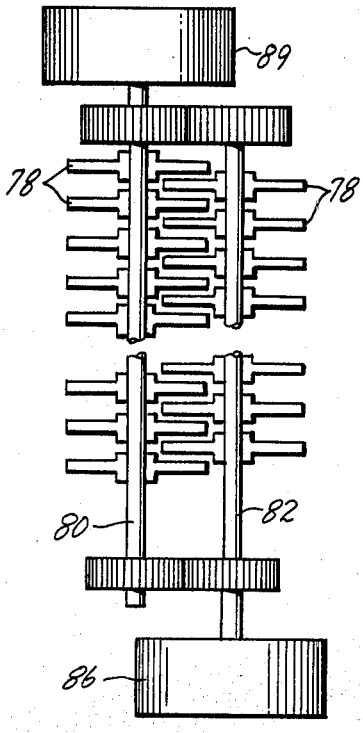
FIG. 4 is a front view partially in section of the ice cutter assembly.

As stated above, the present invention is directed to a semi-submersible cargo transport system generally of the type described in U.S. Pat. No. 3,868,920, hereby incorporated by reference. Thus the present invention comprises a tanker or other cargo vessel which includes a submersible hull 10 which may be quite long in the fore and aft direction and which terminates at either end in a bow section 12 and a stern section 14. Between the bow and the stern sections the hull provides storage for oil or other liquids, but may also be used for storing natural gas as well as solid or fungible commodities. The bow section is provided with diving planes 28 used to control the depth. Similar diving planes 30 are provided in the stern section 14 along with suitable propulsion means including propellers 31. Both the bow and stern are provided with vertical and horizontal thrusters for separately imparting horizontal or vertical positioning of the bow and stern sections even when the hull is motionless in the water. Horizontal thruster ports are indicated respectively at 36 and 38 with vertical thruster ports being indicated at 41 and 43. The horizontal thruster ports open on both sides of the vessel, while the vertical thruster ports open above and below the vessel. Suitable impellers (not shown) move water vertically or horizontally through the thruster ports to impart lateral or vertical movement respectively to the bow and stern sections of the hull. Forward and rear drive is provided by the propellers 31 in conventional manner. The stern section is provided with rudders 35 for steering the vessel when it is underway.

A surface bridge 20 is supported above the surface of the water and ice by a supporting mast 18. The mast 18 is provided with a rotary ice cutter assembly 76. The bridge 20 includes a main section which is rigidly attached to the upper end of the mast 18 and provides space for crews quarters and power equipment for the vessel. In addition, a bridge section 40 provides the location for all the navigational equipment, control equipment, radar and other equipment generally found on the bridge of an ocean going vessel. The bridge section 40 is rotatably mounted on a pedestal 42 on top of the surface bridge 20 for rotation about a vertical axis. A drive motor assembly 44 mounted on the surface bridge has a pinion engaging a suitable ring gear on the bottom of the bridge section 44 imparting relative rotation between the bridge section 40 and the surface bridge 20.

Figure 3:
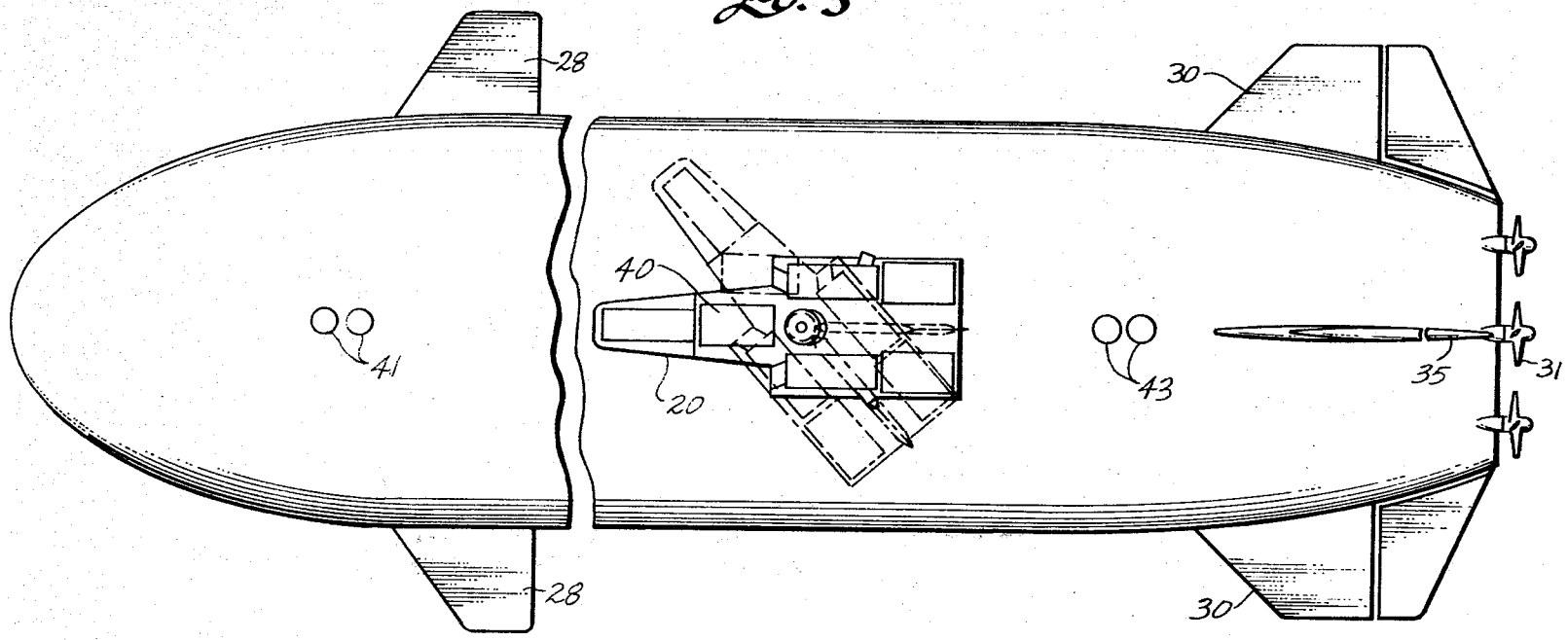
FIG. 3 is a partial top view showing the bow and stern portions of the vessel.
Figure 5:
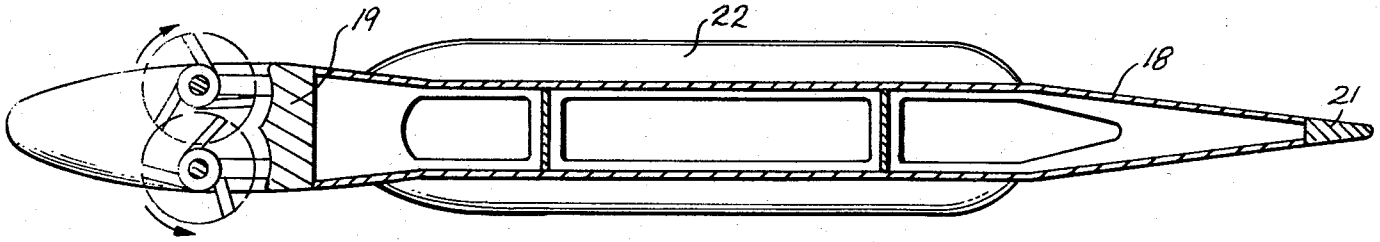
FIG. 5 is a cross-sectional view of the mast taken substantially on the line 5—5 of FIG. 1.

The supporting mast 18 is in the form of a blade having a leading edge 19 and a trailing edge 21. The ice cutter assembly 76, with its two rows of cutters 78, is positioned in front of the leading edge 19. The cutters are mounted on parallel shafts 80 and 82 driven from above and below by motor drives 84 and 86. The cutter assembly and leading edge extend at an angle to the vertical to improve the cutting action. The ice cutter assembly is described in detail in the above-identified patent. Strakes 22 project out from both sides of the supporting mast. The strakes slant upwardly to the rear so that forward motion of the strakes produces a lifting action on the ice particles from the cutters. The strakes 22' below the ice may slant downwardly to push some of the ice particles below the surrounding ice. The mast is preferably hollow in construction with an outer skin and inner bulkheads and gusset plates, in the manner of conventional ship construction. The lower end of the mast 18 is extended in a forward direction in a faired intermediate section 23 and frustoconical base section 25. The base section is journaled in bearings 26 and 27 mounted in an opening 29 extending vertically through the stern section 14 of the vessel 10. The tapered base allows the bearing 27 to be of smaller diameter than the bearing 26 so that the bearings 26 and 27 provide both radial and thrust support for the mast. Also, because of the tapered shape of the base 25, the mast and bridge assembly can be lifted vertically out of the hull, permitting the mast and bridge to be readily removed from the hull while doing repairs or shipping the vessel. Rotation of the mast 18 and surface bridge 20 are supported on the mast within the support bearings 26 and 27 is provided by a suitable electric drive, such as a motor 33 having a pinion 37 engaging a ring gear attached to the bottom of the hull 10. Thus the motor 33 rotates the mast 18 about a common vertical axis to change the angular position of the mast 18 and surface bridge 20 relative to the hull 10. The motor drive 44 and motor drive 33 may be connected as a common selsyn drive, for example, so as to maintain the same angular relationship between the mast and the bridge section 40 and between the mast and the hull 10. In this way the bridge section 40 can be maintained aligned in a fore and aft direction with the hull, as shown in the dotted lines in the top view of FIG. 3. Thus persons navigating the vessel from the bridge are able to maintain their heading aligned with the heading of the hull at all times regardless of changes in the angular orientation of the supporting mast.

Access to the interior of the hull 10 from the surface bridge 20 is provided through the hollow interior of the mast 18. Manhole type locks 70 between the mast and interior of the hull allow the pressure connection when the mast is rotated and locked in the fore-aft position.

What is claimed is:

1. A semi-submersible tanker for operation in ice covered waters, comprising:

a submergible hull including propulsion means, depth control means, and attitude control means for directing the hull beneath the surface of the water and any ice, a bridge section, a bridge supporting mast projecting upwardly from the hull and supporting the bridge section above the surface of the water and any ice, bearing means in the hull supporting the bottom of the mast in the hull for rotation about a substantially vertical axis, rotary ice cutting means supported on and extending along one side of the mast and laterally offset from said axis between the hull and the bridge section for cutting ice encroaching on the mast from the direction of the cutting means, means rotating the supporting mast relative to the hull about said substantially vertical axis to position the ice cutting means between the mast and any encroaching ice, means for rotating the mast relative to the bridge section about an axis parallel to the axis of rotation of the mast relative to the hull, and means maintaining the angular position of the bridge section fixed relative to the hull with rotation of the mast.

2. The tanker of claim 1 wherein the mast has the shape of a flat blade forming a leading edge and a trailing edge, the cutter means extending along the leading edge.

3. The tanker of claim 2 wherein the leading edge of the mast extends at an acute angle to the axis of rotation of the mast.

4. The tanker of claim 3 wherein the cutter means includes a pair of shafts extending parallel to the leading edge of the mast, a plurality of rotary cutters on said shafts, and drive means mounted on the mast for rotating the shaft in counter rotation.

5. Apparatus of claim 1 wherein the lower end of said mast includes a tapered section journaled in said bearing means for transferring a vertical thrust load as well as any lateral load on the mast to the hull, the tapered position of the mast being liftable out of the bearing means and the hull.

* * * * *